US007427750B2

(12) United States Patent
Grossenbacher et al.

(10) Patent No.: US 7,427,750 B2
(45) Date of Patent: Sep. 23, 2008

(54) MASS SPECTROMETER ASSEMBLIES, MASS SPECTROMETRY VACUUM CHAMBER LID ASSEMBLIES, AND MASS SPECTROMETER OPERATIONAL METHODS

(75) Inventors: John W. Grossenbacher, Lafayette, IN (US); Garth E. Patterson, Brookston, IN (US)

(73) Assignee: Griffin Analytical Technologies, L.L.C., West Lafayette, IN (US)

( * ) Notice: Subject to any disclaimer, the term of this patent is extended or adjusted under 35 U.S.C. 154(b) by 175 days.

(21) Appl. No.: 10/542,187

(22) PCT Filed: Jan. 16, 2004

(86) PCT No.: PCT/US2004/001144

§ 371 (c)(1),
(2), (4) Date: Jul. 13, 2005

(87) PCT Pub. No.: WO2004/065920

PCT Pub. Date: Aug. 5, 2004

(65) Prior Publication Data

US 2006/0060771 A1 Mar. 23, 2006

Related U.S. Application Data

(60) Provisional application No. 60/440,887, filed on Jan. 17, 2003.

(51) Int. Cl.
*H01J 49/00* (2006.01)

(52) U.S. Cl. ..... 250/288; 250/281; 250/282; 250/289; 250/423 R; 73/273; 73/431

(58) Field of Classification Search ..... 250/289, 250/281, 296, 288, 298, 283, 282, 423 R, 250/396 R; 73/273, 431
See application file for complete search history.

(56) References Cited

U.S. PATENT DOCUMENTS 4,388,531 A 6/1983 Stafford et al.

(Continued)

FOREIGN PATENT DOCUMENTS

WO US2004/001144 1/2004

OTHER PUBLICATIONS

McLuckey, et al., *High Explosives Vapor Detection by Glow Discharge—Ion Trap Mass Spectrometry*, Rapid Communications In Mass Spectrometry, vol. 10 (1996), pp. 287-298.

(Continued)

*Primary Examiner*—Jack I. Berman
*Assistant Examiner*—Michael J Logie
(74) *Attorney, Agent, or Firm*—Wells St. John P.S.

(57) ABSTRACT

One embodiment of a mass spectrometer assembly includes a base configured to define at least a portion of a vacuum chamber volume; a mass separator component within the vacuum chamber volume; a lid coupled to the mass separator component and configured to be removably operably coupled with respect to the base; and wherein the lid is configured to be positioned in a first operable position to form a hermetical seal with the base and provide the mass separator component within the vacuum chamber volume and a second operable position wherein at least a portion of the lid is spaced from the base and the mass separator component is at least partially removed from within the vacuum chamber volume. Mass spectrometer operational methods are provided that can include at least partially removing the lid from the base, wherein the removing of the lid also at least partially removes the mass separator component from the vacuum chamber volume; and inspecting the mass separator component with the mass separator component removed from the vacuum chamber volume.

6 Claims, 11 Drawing Sheets

U.S. PATENT DOCUMENTS

| | | | | |
|---|---|---|---|---|
| 4,755,685 | A * | 7/1988 | Kawanami et al. | 250/492.2 |
| 4,849,628 | A | 7/1989 | McLuckey et al. | |
| 5,313,061 | A * | 5/1994 | Drew et al. | 250/281 |
| 5,818,055 | A * | 10/1998 | Franzen | 250/292 |
| 5,837,883 | A * | 11/1998 | Itoi | 73/23.37 |
| 5,844,237 | A * | 12/1998 | Whitehouse et al. | 250/288 |
| 5,896,196 | A | 4/1999 | Pinnaduwage | |
| 6,239,429 | B1 * | 5/2001 | Blessing et al. | 250/292 |
| 6,329,654 | B1 * | 12/2001 | Gulcicek et al. | 250/293 |
| 6,410,914 | B1 | 6/2002 | Park et al. | |
| 6,541,768 | B2 * | 4/2003 | Andrien et al. | 250/288 |
| 6,593,568 | B1 * | 7/2003 | Whitehouse et al. | 250/288 |
| 6,825,466 | B2 * | 11/2004 | Mordekhay | 250/288 |
| 2002/0053636 | A1 * | 5/2002 | Shiokawa et al. | 250/281 |
| 2002/0125425 | A1 * | 9/2002 | Kato | 250/288 |
| 2006/0219898 | A1 * | 10/2006 | McLuckey et al. | 250/288 |

OTHER PUBLICATIONS

Johnson, et al., *Membrane Introduction Mass Spectrometry; Trends And Applications*, Mass Spectrometry Reviews (2000) 19, pp. 1-37.

Carroll, et al., *A Dual Vacuum Chamber Fourier Transform Mass Spectrometer with Rapidly Interchangeable LSIMS, MALDI, and ESI Sources: Initial Results with LSIMS and MALDI*, Analytical chemistry, vol. 78, No. 10, May 15, 1996, pages.

http://www.micromass.co.uk; 3 pps.

Vestal, Marvin L.; Methods of Ion Generation;Chem Rev. 2001, 101(2); pp. 361-375.

* cited by examiner

Note: Spectrum was collected in two segments.

MASS SPECTROMETER ASSEMBLIES, MASS SPECTROMETRY VACUUM CHAMBER LID ASSEMBLIES, AND MASS SPECTROMETER OPERATIONAL METHODS

RELATED PATENT DATA

This application is a 35 U.S.C. §371 of and claims priority to PCT International Application No. PCT/US04/01144, which was filed 16 Jan. 2004 (16.01.04), and was published in English, which claims priority under 35 U.S.C. §119 to U.S. Provisional Patent Application Ser. No. 60/440,887 filed Jan. 17, 2003 entitled "Interchangeable Mass Spectrometer Inlet/Ionization Source", the entirety of both of which are incorporated by reference herein.

TECHNICAL FIELD

The present disclosure relates generally to chemical analysis and more particularly to mass spectrometer assemblies, mass spectrometry vacuum chamber lid assemblies, and mass spectrometer operational methods.

BACKGROUND ART

Characterization of compounds utilizing mass spectrometry and varying sources of ionization is well accepted in the field of analytical chemistry as a technique that allows for the further elucidation of analytes and their specific chemistries. However, mass spectrometer instrumentation is costly and because most labs are unable to configure many instruments with unique ionization sources, analysts are typically required to configure one instrument with a single source and then reconfigure with different sources as analysis dictates. This change-out between sources can be problematic, particularly since mass spectrometer instrumentation must be configured under a vacuum and nanogram quantities of contaminant materials can provide background noise rendering the instrument practically useless.

SUMMARY

Mass spectrometer assemblies are provided that can include in one embodiment: a base configured to define at least a portion of a vacuum chamber volume within which at least some operations may be performed with respect to mass spectrometry; a mass separator component configured to perform at least some operations with respect to mass spectrometry within the vacuum chamber volume; a lid coupled to the mass separator component and configured to be removably operably coupled with respect to the base; and wherein the lid is configured to be positioned in a first operable position to form a hermetical seal with the base and provide the mass separator component with the vacuum chamber volume and a second operable position wherein at least a portion of the lid is spaced from the base and the mass separator component is at least partially removed from the vacuum chamber volume.

Mass spectrometry vacuum chamber lid assemblies are provided that can include, in one embodiment, a body having an interior surface coupled to a mass separator component, wherein the body is configured to at least partially define a volume partially surrounding the mass separator component when the body is hermetically sealed to a housing of a vacuum chamber assembly, wherein the body is further configured to be removable from the vacuum chamber volume to at least partially remove the mass separator component from the vacuum chamber volume.

Mass spectrometer operational methods are provided that can include, in one embodiment: providing a mass spectrometry assembly comprising a base and a lid, the base and lid substantially defining a vacuum chamber volume when the lid is affixed to the base in a position operable to perform at least some operations with respect to mass spectrometry, wherein a mass separator component is coupled to the lid and occupies a portion of the vacuum chamber volume in the position; first performing mass analysis using the mass spectrometry assembly in the position; after the first performing, at least partially removing the lid from the base, wherein the at least partially removing of the lid also at least partially removes the mass separator component from the vacuum chamber volume; inspecting the mass separator component with the mass separator component removed from the vacuum chamber volume; returning the lid to the position after the inspecting; and second performing mass analysis using the mass separator after the returning.

BRIEF DESCRIPTION OF THE DRAWINGS

Preferred embodiments of the invention are described below with reference to the following accompanying drawings.

FIG. 10 is example data acquired utilizing assemblies and methods of the disclosure.

DETAILED DESCRIPTION OF THE PREFERRED EMBODIMENTS

At least some embodiments provide mass spectrometry assemblies and mass spectrometer operational methods. Exemplary configurations of these assemblies and methods are described with reference to FIGS. 1-11.

Figure 1:
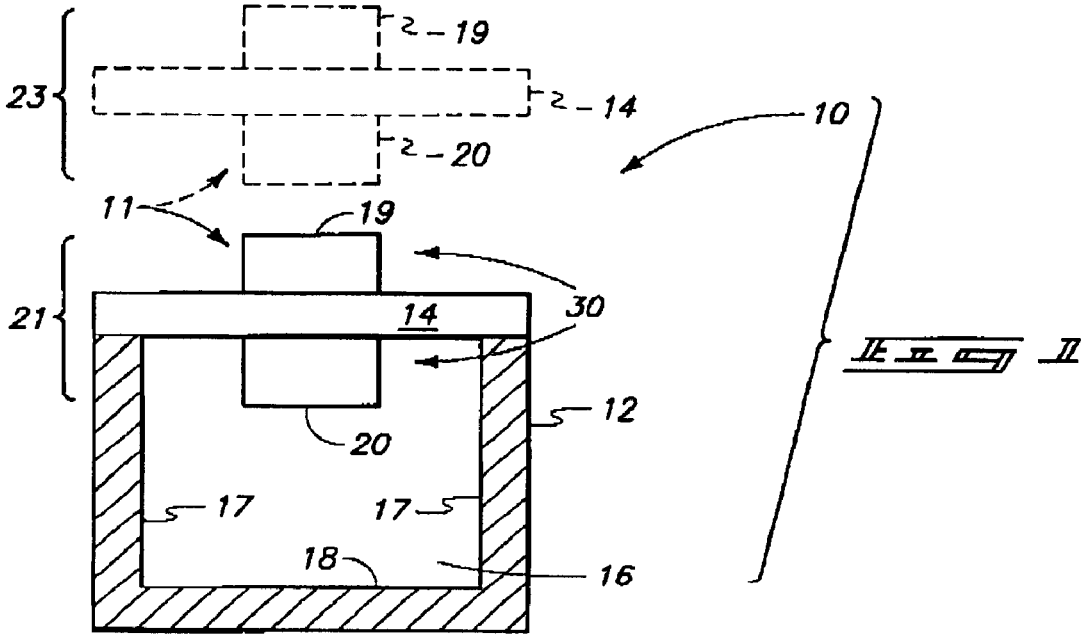
FIG. 1 is an illustrative representation of a mass spectrometry assembly according to an embodiment.

Referring first to FIG. 1, a mass spectrometry assembly 10 is shown that comprises a base 12 and a lid 14. Together lid 14 and base 12 can define a volume 16. In an exemplary embodiment lid 14 and base 12 define a vacuum chamber housing of mass spectrometry assembly 10. The vacuum chamber housing can define volume 16 which can be referred to as a vacuum chamber volume in embodiments wherein a vacuum is provided. A vacuum source (not shown) can be in fluid connection to base 12 and provide vacuum to volume 16.

Base 12 can be constructed of a single structure or can be constructed of multiple components. Exemplary components include walls 17 and a bottom 18. In the exemplary configuration of FIG. 1, walls 17 may be a continuous wall of a cylinder. Other geometries or arrangements of base 12 are possible. The structure and or components of base 12 and/or lid 14 can be fabricated of materials such as aluminum, stainless steel, and/or other materials. In exemplary embodiments lid 14 can be referred to as a body or as a flange and/or an adapter. According to exemplary aspects, base 12 can be configured to define at least a portion of volume 16. In exemplary embodiments walls 17 of base 12 can be affixed to lid 14 by a hermetical seal (not shown). An exemplary hermetical seal can include an O-ring arrangement between lid 14 and base 12. An appropriate removable fastener (not shown) may also be provided to maintain lid 14 and base 12 in a sealed arrangement.

In one embodiment, mass spectrometry assembly 10 comprises one or more components configured to perform operations with respect to mass spectrometry analysis, and accordingly, such components may be referred to as mass spectrometry components 30. In one possible implementation, lid 14 is coupled with one or more of components 30. Further, an individual one of components 30 may be internally or externally coupled with lid 14. For example, in the embodiment shown in FIG. 1, lid assembly 11 comprises lid 14 coupled with an external component 19 and an internal component 20. In the illustrated exemplary embodiment, external component 19 is external of a volume 16 and internal component 20 is at least partially within volume 16. An individual one of components 30 may also be provided coupled with lid 14 in other arrangements, for example, internal of or defined by a volume of lid 14.

Within volume 16 at least some mass spectrometry operations can be performed using internal component 20. Some mass spectrometry operations can also be performed using external component 18. In an exemplary aspect, lid 14 and/or lid assembly 11 can be configured to be removably operably coupled with respect to base 12. Lid 14 can be configured to be positioned in a first operable position 21. In position 21, lid 14 can form a hermetical seal with base 12 and provide component 20 within volume 16. In position 21, mass spectrometry assembly 10 can be used to perform at least some operations with respect to analysis of a sample.

Lid 14 can also be configured to be positioned in a second operable position 23. In position 23, at least a portion of lid 14 can be spaced from base 12 and component 20 can be at least partially removed from volume 16. In an exemplary aspect, an entirety of lid 14 can be spaced from base 12 and component 20 can be at least partially removed from volume 16. In another exemplary aspect, at least a portion of lid 14 can be spaced from base 12 and component 20 can be entirely removed from volume 16. In another exemplary aspect, an entirety of lid 14 can be spaced from base 12 and an entirety of component 20 can be removed from volume 16. Second operable position 23 facilitates access to internal equipment 20 in one embodiment. Other operable positions intermediate operable positions 21 and 23 are possible. The plural operable positions of lid 14 and/or lid assembly 11 may refer to an exemplary embodiment of assembly 10 where lid 14 and/or lid assembly 11 are detached and reattached numerous times with respect to base 12 when used during mass spectrometry operations (e.g. service, reconfiguration, maintenance, etc.).

Figure 2:
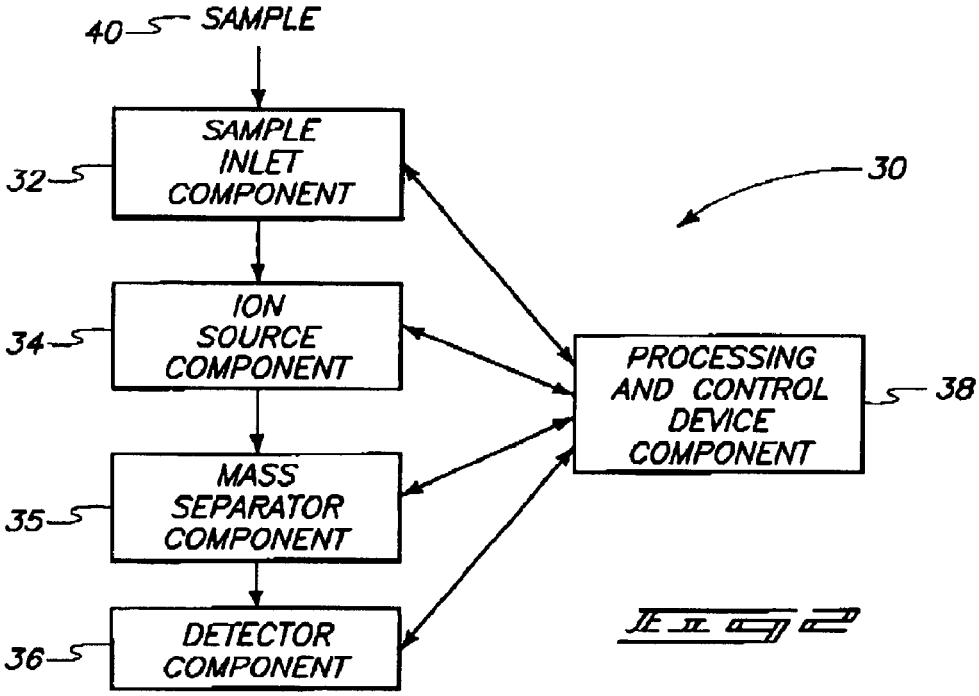
FIG. 2 is a block diagram of mass spectrometry components according to an embodiment.

Referring next to FIG. 2, components 30 of a mass spectrometer according to one embodiment are shown. As represented in FIG. 2, components 30 can include a sample inlet component 32 operationally connected to an ion source component 34 which can be operationally connected to a mass separator component 35 which can be operationally connected to a detector component 36. These general components can be operationally connected to a processing and control device component 38. Exemplary embodiments provide for the use of components 30 to perform mass spectrometry. Components 30 can be operationally connected as shown in FIG. 2 or operationally connected in other configurations enabling mass spectrometry operations. Further, other arrangements including more or less or alternative components are possible.

As depicted in FIG. 2, a sample 40 can be introduced into sample inlet component 32. For purposes of this disclosure, sample 40 represents any chemical composition including both inorganic and organic substances in solid, liquid and/or vapor form. Specific examples of sample 40 suitable for analysis include volatile compounds such as toluene or other specific examples including highly-complex non-volatile protein based structures such as bradykinin. In certain aspects, sample 40 can be a mixture containing more than one substance or in other aspects sample 40 can be a substantially pure substance. Analysis of sample 40 can be performed according to exemplary aspects described below.

Sample inlet component 32 can be configured to introduce an amount of sample 40 into assembly 10 (FIG. 1) for analysis. Depending upon sample 40, sample inlet component 32 may be configured to prepare sample 40 for ionization. Types of sample inlet components 32 can include batch inlets, direct probe inlets, chromatographic inlets, and permeable, semi-permeable, solid phase microextraction (SPME), and/or capillary membrane inlets. Sample inlet component 32 can also include means for preparing sample 40 for analysis in the gas, liquid and/or solid phase. In some aspects, sample inlet component 32 may be combined with ion source component 34.

Ion source component 34 can be configured in exemplary embodiments to receive sample 40 directly or in other exemplary embodiments to receive sample 40 from sample inlet component 32. Ion source component 34 can be configured to convert portions or an entirety of sample 40 into analyte ions in one example. This conversion can include the bombardment of sample 40 with electrons, ions, molecules, and/or photons. This conversion can also be performed by thermal or electrical energy.

Ion source component 34 may utilize, for example, electron ionization (EI, typically suitable for the gas phase ionization), photo ionization (PI), chemical ionization, collisionally activated disassociation and/or electrospray ionization (ESI). For example in PI, the photo energy can be varied to vary the internal energy of the sample. Also, when utilizing ESI, sample 40 can be energized under atmospheric pressure and potentials applied when transporting ions into volume 16 of exemplary mass spectrometer assembly 10 (FIG. 1) can be varied to cause varying degrees of dissociation.

The analyte ions can proceed to mass separator component 35. Mass separator component 35 can include one or more of linear quadrupoles, triple quadrupoles, quadrupole ion traps (Paul), cylindrical ion traps, linear ion traps, rectilinear ion traps, ion cyclotron resonance, quadrupole ion trap/time-of-flight mass spectrometers, or other structures. Mass separator component 35 can also include focusing lenses as well as tandem mass separator components such as tandem ion traps or ion traps and quadrupoles in tandem. In one implementation at least one of multiple tandem mass separator components can be an ion trap. Tandem mass separator components can be placed in series or parallel. In an exemplary implementation, tandem mass separator components can receive ions from the same ion source component. In an exemplary aspect the tandem mass separator components may have the same or different geometric parameters. The tandem mass separator components may also receive analyte ions from the same or multiple ion source components.

Analytes may proceed to detector component 36. Exemplary detector components include electron multipliers, Faraday cup collectors, photographic and scintillation-type detectors. The progression of mass spectrometry analysis from sample inlet component 32 to detector component 36 can be controlled and monitored by a processing and control device component 38.

Acquisition and generation of data can be facilitated with processing and control device component 38. Processing and control device component 38 can be a computer or minicomputer or other appropriate circuitry that is capable of controlling components 30. This control can include for example the specific application of voltages to ion source component 34 and mass separator component 35, as well as the introduction of sample 40 via sample inlet component 32 and may further include determining, storing and ultimately displaying mass spectra recorded from detector component 36. Processing and control device component 38 can contain data acquisition and searching software. In one aspect such data acquisition and searching software can be configured to perform data acquisition and searching that includes the programmed acquisition of total analyte count. In another aspect, data acquisition and searching parameters can include methods for correlating the amount of analytes generated to predetermine programs for acquiring data.

Referring again to FIG. 1, individual ones of the general components of a mass spectrometer may be positioned as an internal component 20 or as an external component 19 as desired by those of ordinary skill in the art. For example, in different applications or configurations, individual ones of general components 32-26 may be arranged as internal or external components as desired. In one embodiment, internal component(s) 20 can include one or more of sample inlet component 32, ion source component 34, mass separator component 35 and/or the detector component 36 in various configurations to perform mass spectrometry. In one embodiment, external component(s) 19 can include one of more of sample inlet component 32, ion source component 34 and/or processing and control device 36.

In an exemplary embodiment, internal and/or external components include multiple components such as multiple ion source components. These multiple components can be configured as external, internal or external and internal components.

Exemplary arrangements of the mass spectrometry components and lid assemblies are shown in FIGS. 3*a*-3*d*.

Figure 3A:
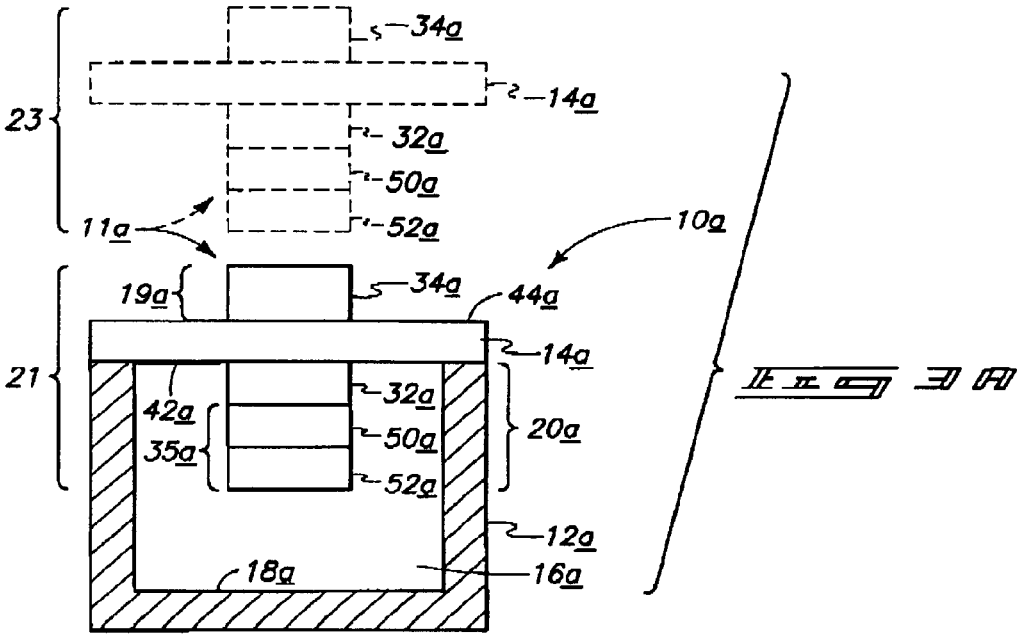
FIG. 3*a* is an illustrative representation of a mass spectrometry assembly according to an embodiment.

Referring to FIG. 3*a*, an exemplary mass spectrometer assembly 10*a* is shown that includes lid 14*a*, base 12*a* and volume 16*a*. Lid 14*a* can include an interior surface 42*a* and an exterior surface 44*a*. Exemplary embodiments include lid assembly 11*a* that can include external component 19*a* including ion source component 34*a* coupled to external surface 44*a*. In the exemplary depiction, lid assembly 11*a* can include internal components 20*a* including sample inlet component 32*a* and mass separator component 35*a* including focusing lenses 50*a* and an ion trap 52*a* coupled to internal surface 42*a* to process analytes in a direction that is substantially perpendicular to the alignment of inner surface 42*a* toward the detector component (not shown). For example, analytes can be processed in a direction towards bottom 18*a* of base 12*a*. Sample inlet component 32*a* can be located between mass separator component 35*a* and internal surface 42*a*. Sample inlet component 34*a* and mass separator component 35*a* can be in a substantially stacked configuration below and coupled to inner surface 42*a*.

Figure 3B:
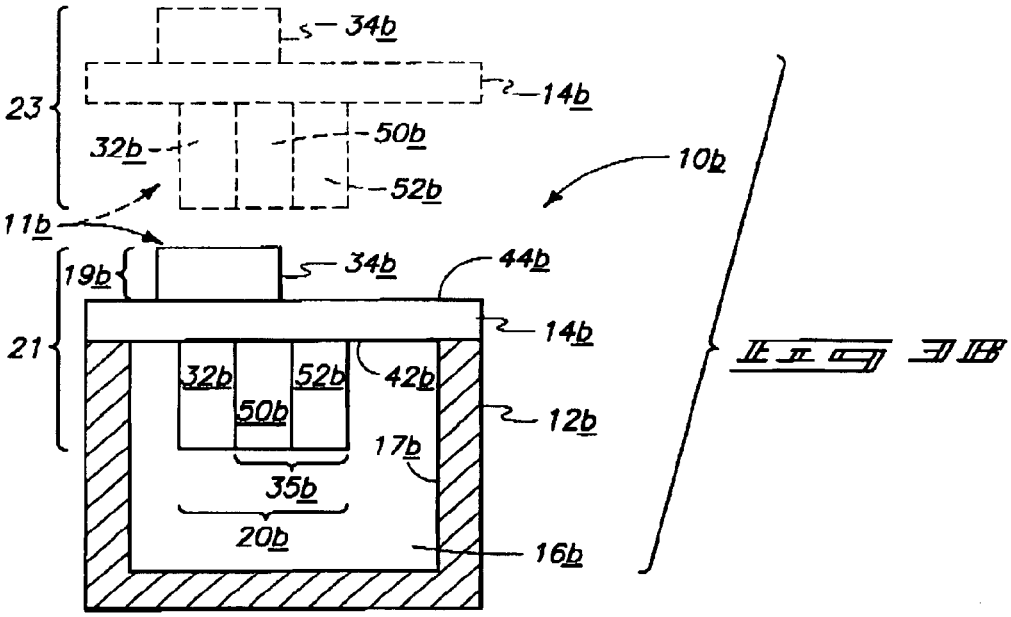
FIG. 3*b* is an illustrative representation of a mass spectrometry assembly according to an embodiment.

Referring to FIG. 3*b*, an exemplary mass spectrometry assembly 10*b* is shown that includes ion source component 34*b* coupled to external surface 44*b*. Lid assembly 11*b* can include lid 14*b* coupled to one or both of external component 19*b* and/or internal component 20*b*. As exemplarily depicted, internal components 20*b* include sample inlet component 34*b* and mass separator components 35*b* including focusing lenses 50*b* and ion trap 52*b* coupled to internal surface 42*b* to process analytes in a direction that is substantially parallel to the alignment of inner surface 42*b* toward the detector component (not shown). For example, analytes can be processed in a direction towards wall 17*b* of base 12*b*.

Referring again to FIGS. 3*a* and 3*b*, in operable position 21, internal components 20*a-b* including sample inlet component 34*a-b*, focusing lenses 50*a-b* and ion trap 52*a-b* and detector (not shown) can be within volume 16*a-b*. In an exemplary embodiment volume 16*a-b* can at least partially surround internal components 20*a-b* when lid 14*a-b* is in operable position 21. In other exemplary aspects internal components 20*a-b* can also include ion source component 34*a-b*.

In operable position 23, one or more of internal components 21*a-b* including sample inlet component 34*a-b*, focusing lenses 50*a-b*, and ion trap 52*a-b* can be at least partially removed from volume 16*a-b*. In an exemplary aspect, in operable position 23, one or more of the internal components can be entirely removed from volume 16*a-b*. For example and by way of example only, in operable position 23: sample inlet component 32*a-b* can be entirely removed from volume 16*a-b* while mass separator component 35*a-b* is not removed; sample inlet component 34*a-b* and focusing lenses 50*a-b* can be entirely removed from volume 16*a-b* while ion trap 52*a-b* is not removed; sample inlet component 32*a-b* and ion trap 52*a-b* can be entirely removed while focusing lenses 50*a-b* are not removed; both sample inlet component 32*a-b* and mass separator component 35*a-b* including both focusing lenses 50*a-b* and ion trap 52*a-b* can be entirely removed; focusing lenses 50*a-b* can be entirely removed while ion trap 52*a-b* is not removed; and/or ion trap 52*a-b* can be entirely removed while focusing lenses 50*a-b* are not removed from volume 16*a-b*.

Figure 3C:
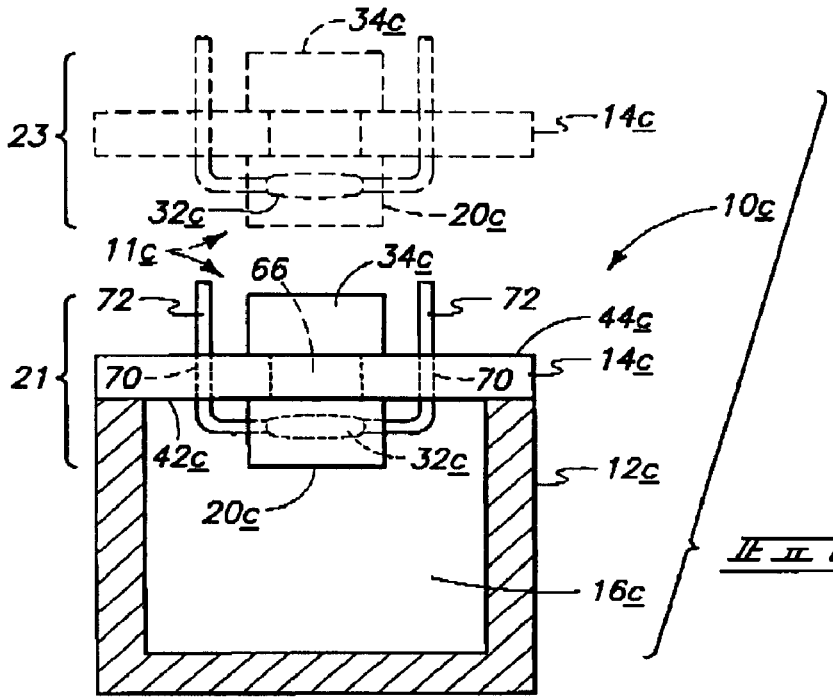
FIG. 3*c* is an illustrative representation of a mass spectrometry assembly according to an embodiment.

Referring next to FIG. 3*c*, another exemplary mass spectrometry assembly 10*c* is shown and includes base 12*c* and lid 14*c*. As shown in FIG. 3*c*, lid 14*c* can include an interior surface 42*c*, an exterior surface 44*c*, and an opening 66 extending from interior surface 42*c* to exterior surface 44*c*. In the exemplary Figure, ion source component 34*c* is coupled to exterior surface 44*c*. In an exemplary aspect ion source component 34*c* can be coupled to exterior surface 44*c* in fluid communication with opening 66. In the exemplary depiction, internal components 20*c* can be coupled to interior surface 42*c*. In an exemplary aspect internal components 20*c* can couple to interior surface 42*c* in fluid communication with opening 66. Exemplary aspects include providing fluid communication between external components 19*c* and internal components 20*c* via opening 66. In an exemplary embodiment, ion source component 34*c* is in fluid communication with sample inlet component 32*c* through opening 66. Lid assembly 11*c* can include lid 14*c* having opening 66 and one or both of internal components 20*c* and external components 19*c*.

Lid 14*c* can also be configured to provide sample 40 (FIG. 2) to sample inlet component 32*c*. In an exemplary embodiment openings 70 can be provided that extend into volume 16*c* from outside volume 16*c* through lid 14*c*. Sample tubing 72 can be provided through or as part of openings 70 and configured to provide sample 40 to sample inlet component 32*c*. In first operable position 21 internal component(s) 20*c* including sample inlet component 32*c* can be within volume 16*c*. In second operable position 23, portions or an entirety of one or more internal component(s) 20*c* which can include sample inlet component 32*c* can be removed from volume 16*c*.

Figure 3D:
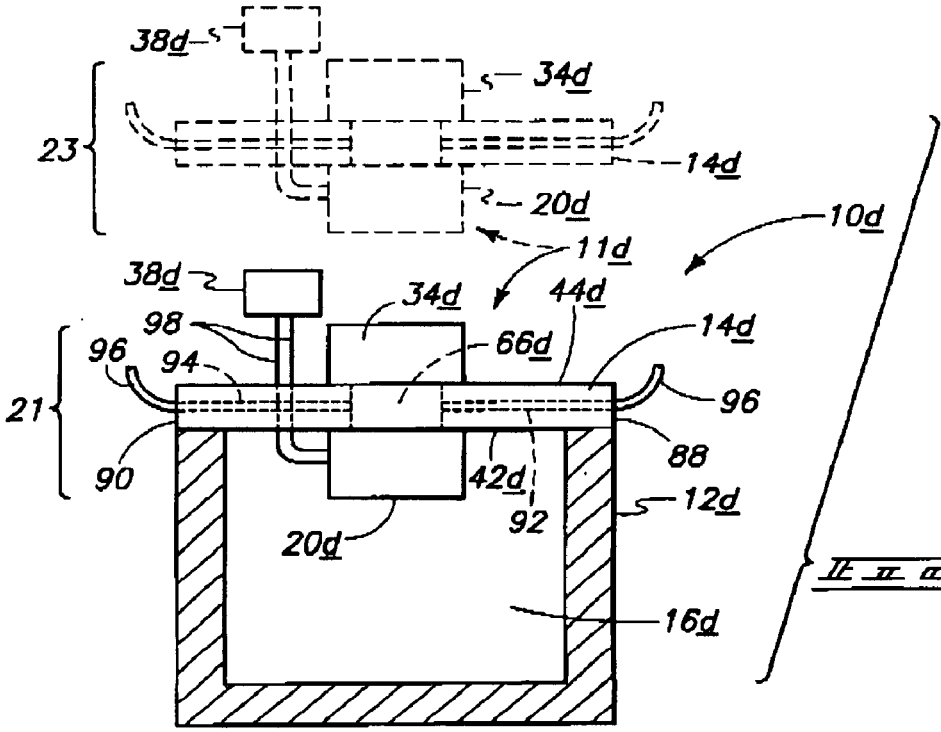
FIG. 3*d* is an illustrative representation of a mass spectrometry assembly according to an embodiment.

Referring next to FIG. 3*d*, mass spectrometry assembly 10*d* is shown including lid 14*d* having an interior surface 42*d* and an exterior surface 44*d* having opening 66*d* therethrough, and edges 88 and 90 extending between interior surface 42*d* and exterior surface 44*d*. In an exemplary embodiment, lid 14*d* includes openings 92 and 94 extending from edge 88 and edge 90 respectively to and in fluid communication with opening 66*d*. In an exemplary aspect openings 92 and 94 can provide fluid communication between outside of volume 16*d* and opening 66*d*. Conduit or tubing 96 can be configured to facilitate fluid communication to opening 66*d* through openings 92 and 94. Embodiments of lid 14*d* also include single openings extending from a single edge such as edge 88 and opening 92 to opening 66*d*. Embodiments of lid 14*d* also include openings (not shown) extending from outside volume 16*d* such as exterior surface 88 to opening 66. Openings 92 and 94 can be utilized in exemplary aspects to: provide auxiliary pumping to opening 66*d*; to provide reagent gas such as chemical ionization reagent gases to opening 66*d* during ionization using ion source 34*d*; and/or to provide sample 40 to opening 66*d*. In an exemplary embodiment, opening 92 can serve as an inlet port while opening 94 may serve as an outlet port for samples circulating through tubing within lid 14*d*. Openings 92 and/or 94 can also provide for gas pumping on central opening 66*d* should an intermediate pressure be needed for proper operation of ion source component 34*d* or in the event of a large sample influx such as is the case with liquid samples.

Lid 14*d* can also be configured to provide control and/or power to internal component 20*d* for example through electrical wiring 98. Electrical wiring 98 can be incorporated as part of lid 14*d* or through openings provided in lid 14*d*. Electrical wiring 98 can be configured to control internal component(s) 20*d* such as sample inlet component 32 and mass separator component 35 from processing and control device component 38. In first operable position 21 internal component(s) 20*d* and at least some wiring 98 can be within volume 16*d*. In second operable position 23, portions or an entirety of one or more internal component(s) 20*d* and wiring 98 can be removed from volume 16*d*. Exemplary embodiments provide for lid assembly 11*d* that includes lid 14*d* and one or both of internal component 19*d* and/or internal component 20*d*.

Figure 4:
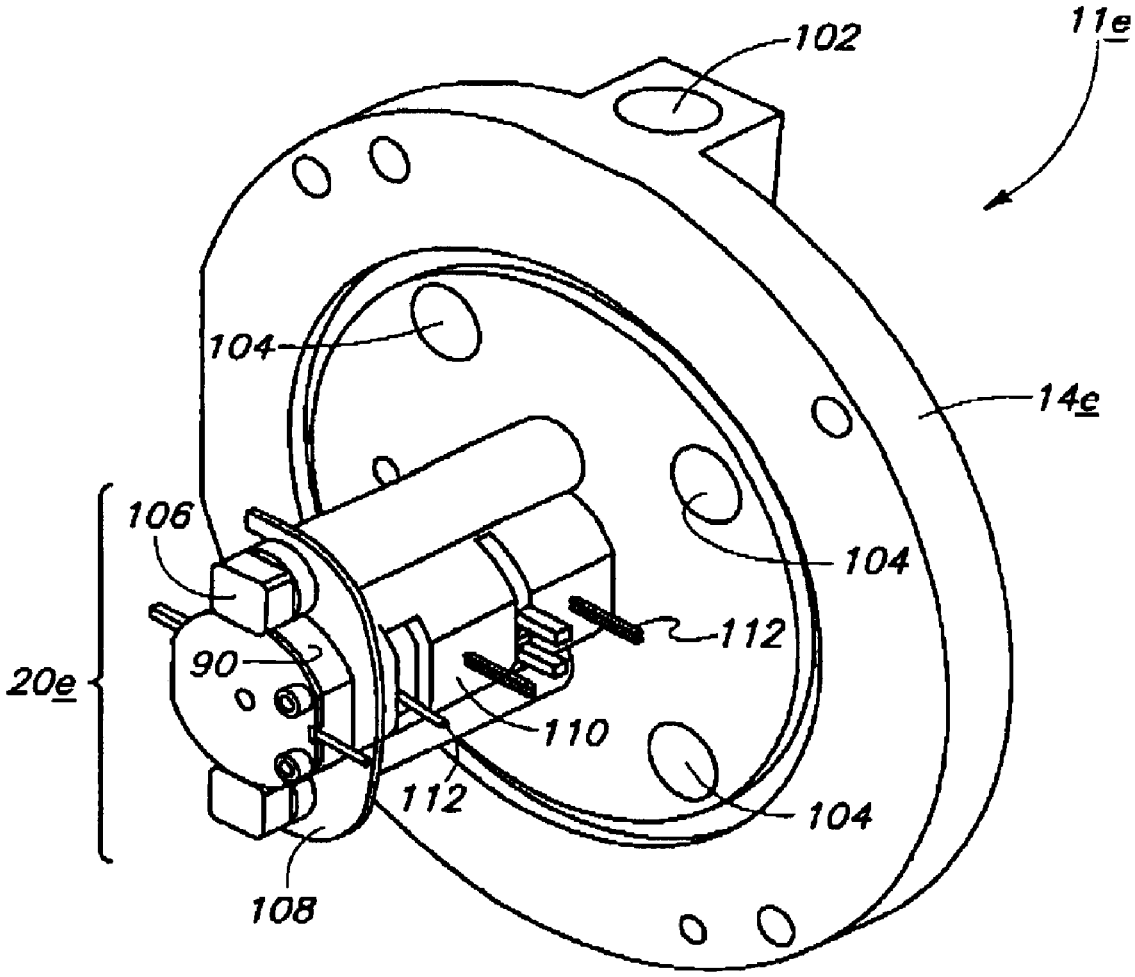
FIG. 4 is an isometric view of a mass spectrometry assembly according to an embodiment.

Referring next to FIG. 4, an exemplary mass spectrometer vacuum chamber lid assembly 11*e* is shown in isomeric view that includes a lid 14*e* and internal components 20*e* which may comprise mass separator components. Assembly 11*e* may be used in the arrangements of FIGS. 1 and 3 in exemplary configurations. Components 20*e* can be coupled to lid 14*e* via one or more of a mounting rod 106 and a retainer clip 108. Mass separator components 20*e* can be confined within mass separator housings 110 and can be controlled via electrical signals provided to electrical connections 112. In one embodiment, mass separator housing 110 includes insulating material. As shown in FIG. 4, lid 11*e* includes openings 104 (see e.g., opening 70, FIG. 3*c*) and 102 (see e.g., opening 92, FIG. 3*d*). In an exemplary aspect openings 104 can be used to pass wiring, sample, and/or other mass spectrometry components into volume 16 (FIG. 1). Opening 102 may be used as described above with reference to opening 92.

Figure 5A:
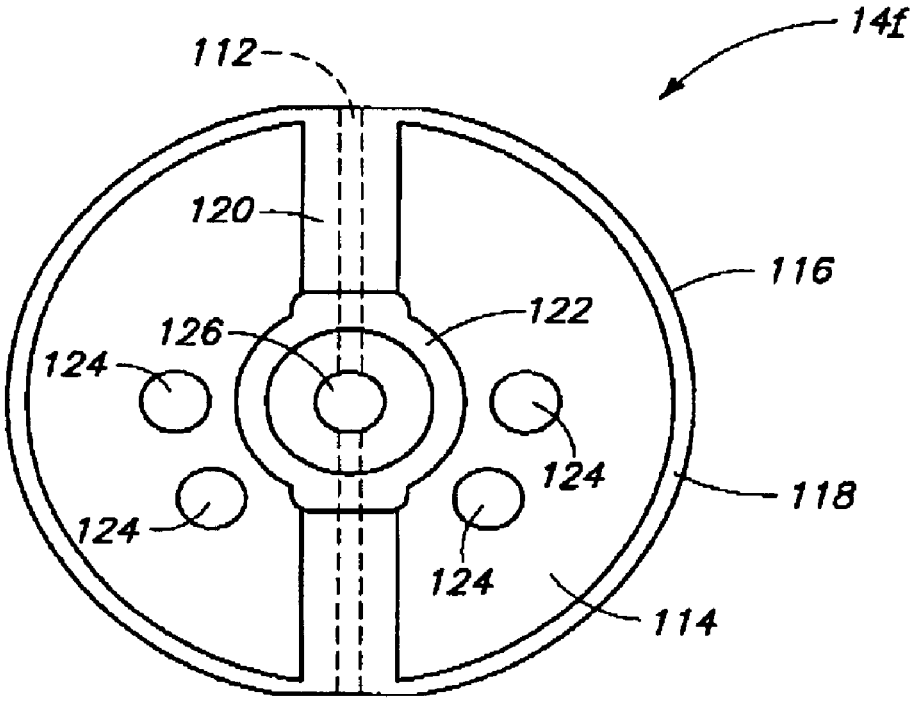
FIG. 5*a* is a plan view of a mass spectrometry assembly according to an embodiment.
Figure 5B:
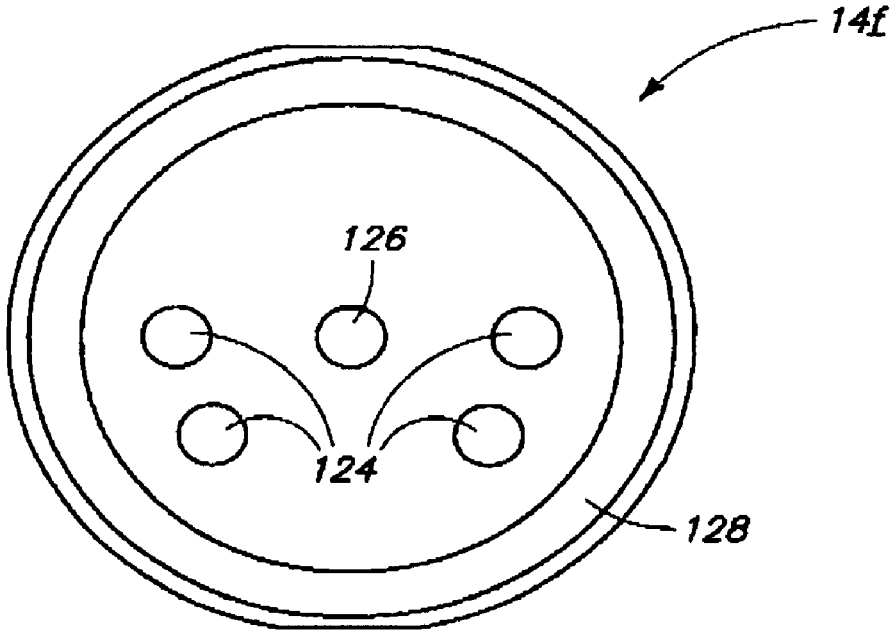
FIG. 5*b* is a plan view of the mass spectrometry assembly of FIG. 5*a* according to an embodiment.
Figure 5C:
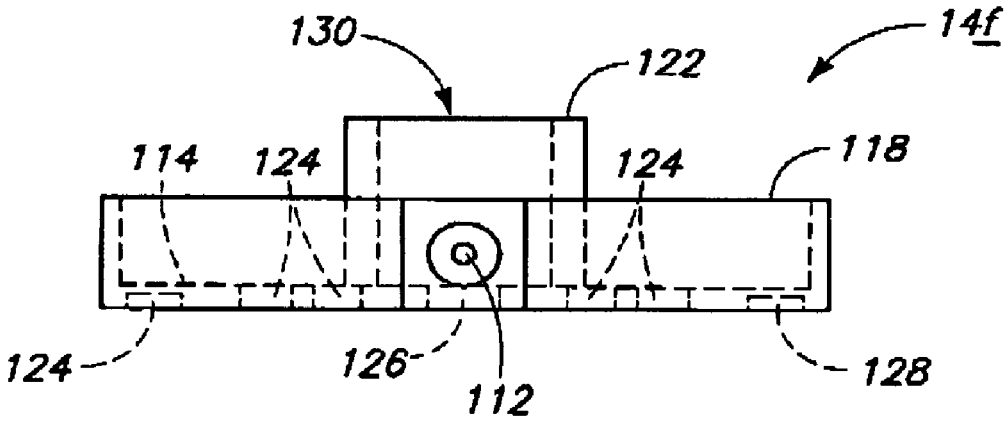
FIG. 5*c* is a side view of the mass spectrometry assembly FIGS. 5*a* and 5*b* according to an embodiment.

Referring next to FIGS. 5*a*-5*c* an exemplary embodiment of lid 14*f* is shown in differing views. Referring first to FIG. 5*a* an exterior view of lid 14*f* is shown having recessed portions 114 radially inward of edges 116 providing an elevated lip 118. Recessed portion 114 can also be referred to as a groove. Openings 124 are provided through lid 14*f* in an exemplary embodiment to provide for feed through connections of electrical wiring and/or sample inlet components. Lid 14*f* can also include elevated portions 120, in an exemplary embodiment bisecting lid 14*f*. Opening 126 can be provided through the canter of lid 14*f* to facilitate, in an exemplary aspect, the introduction of ions, samples or other materials provided during mass spectrometry. Lid 14*f* can also include adaptive portions 122 to facilitate the coupling of external components 19 (not shown) such as ion source component 34. In an exemplary embodiment opening 112 can extend bisecting lid 14*f* and through opening 126 to provide fluid communication between edge 116 and opening 126.

Referring next to FIG. 5*b*, internal surface view of body 14*f* is shown that includes a recessed portion 128 that can facilitate the hermetical sealing of lid 14*f* to base 12 of a mass spectrometry assembly 10 (FIG. 1). Referring next to FIG. 5*c*, a side view of lid 14*f* is shown. As shown lip 118 and adaptive portions 122 can extend above recessed surface 114.

Figure 6:
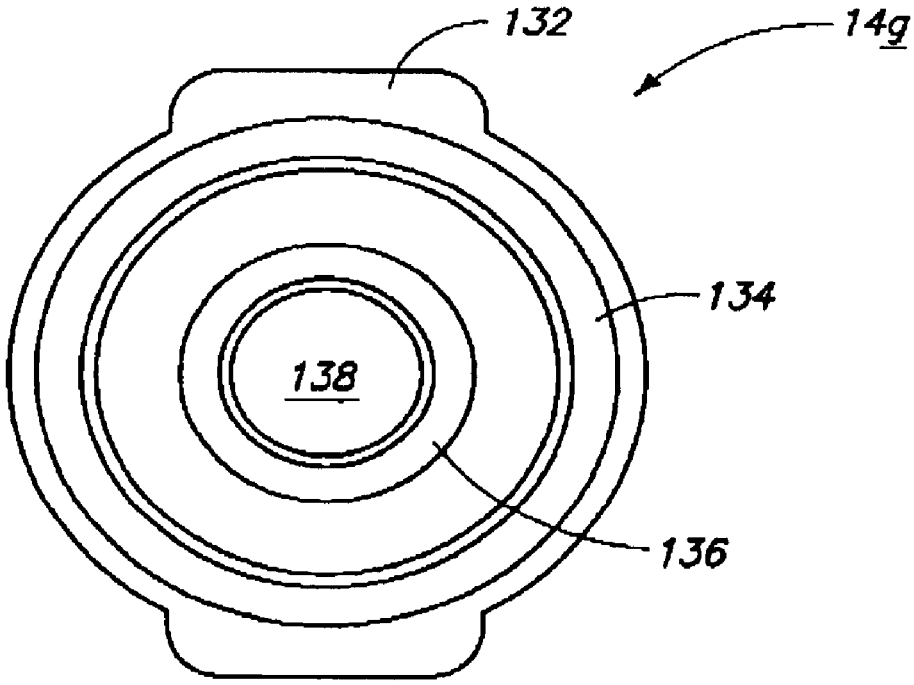
FIG. 6 is a plan view of a mass spectrometry assembly according to an embodiment.

Referring next to FIG. 6, an external view of an exemplary embodiment of lid 14*g* is shown that includes recessed groove 134 as well as a mating surface 132 to facilitate sealing lid 14*g* to base 12 (FIG. 1). In an exemplary embodiment, base 12 can include a complimentary mating surface (not shown) to mating surface 132. Exemplary embodiments of lid 14*g* can also include a circular plate 136 that in certain aspects can be installed within opening 138 to maintain a pressure in opening 126 (FIGS. 5*a*-*c*) that is higher than that within volume 16 (FIG. 1).

Figure 7:
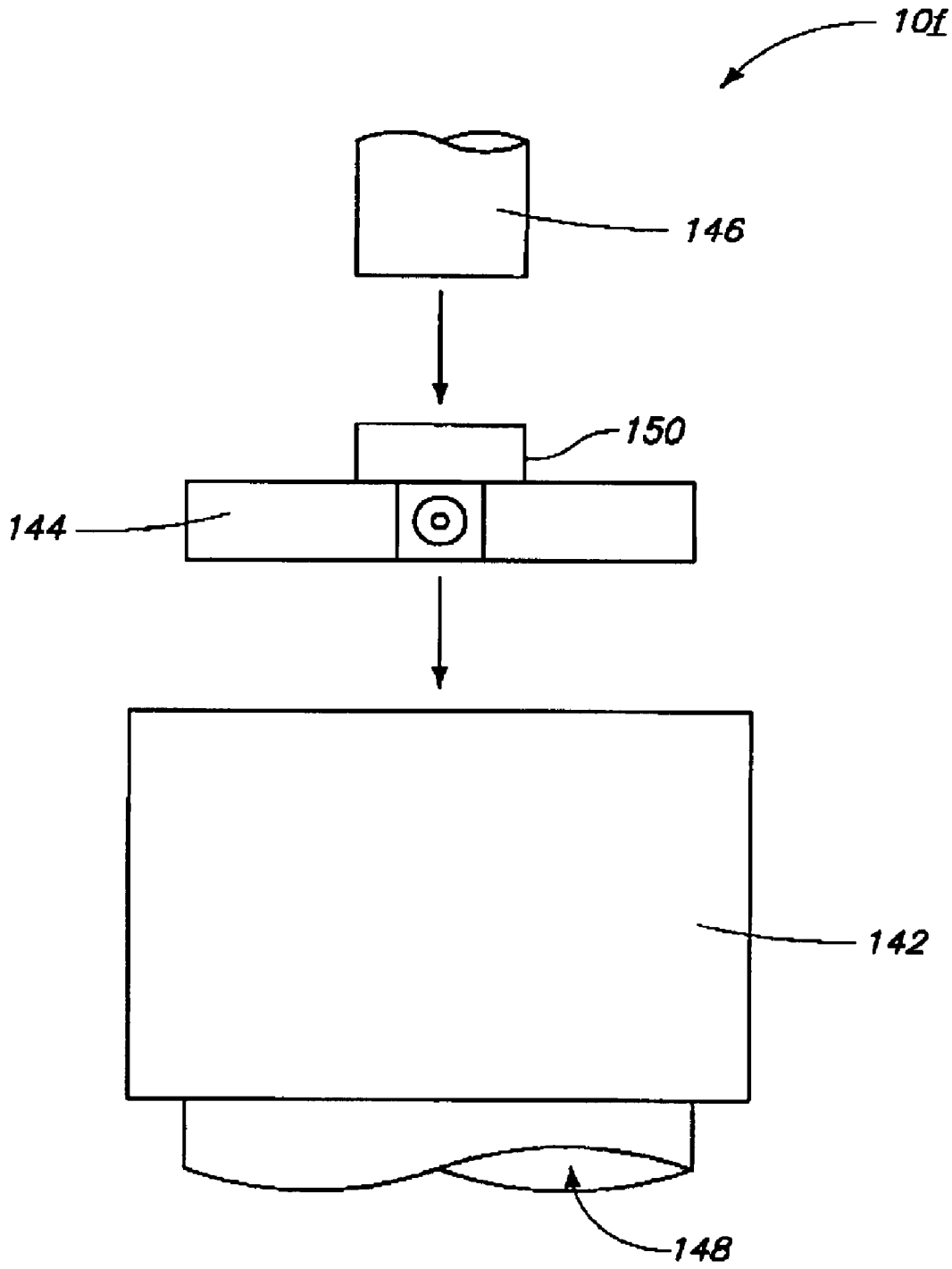
FIG. 7 is an illustrative representation of a mass spectrometry assembly according to an embodiment.

Referring to FIG. 7, a mass spectrometry assembly 10*f* is shown that includes a base 142, a lid 144 and an external component 146. As shown, base portion 142 also includes an opening 148 that in an exemplary embodiment allows access to vacuum pumping and/or detection of ions separated utilizing assembly 10*f*. As exemplarily depicted in FIG. 7, external component 146 can include ion source component 34 and in one embodiment can be removably operably coupled with respect to lid 144 and configured to be positioned in a first operable position (not shown) to seal with lid 144 and a second operable position where at least a portion of external component 146 is spaced from lid 144.

Other aspects provide for the configuration of assembly 10*f* with multiple components. Multiple ion sources can be configured to couple with lid 144 in one embodiment. In an exemplary aspect, different ion sources can be configured to be exchanged and/or replaced with respect to assembly 10*f*. In an exemplary embodiment, an electron impact ion source may be replaced with a chemical ionization ion source.

Referring to the figures discussed above, mass spectrometer operational methods are also provided that include first performing mass analysis using mass spectrometry assembly 10 in operable position 21. This performance can include providing sample 40 to volume 16 as described above.

According to an exemplary aspect, mass analysis can include providing ions to the vacuum chamber volume through opening 66 (FIG. 3*c*) and contacting the ions with sample 40. Contacting sample 40 with the ions can occur within opening 66. In an exemplary embodiment mass analysis can include providing a chemical ionization plasma and a chemical ionization reagent gas, for example through openings 92, to opening 66*d* (FIG. 3*d*) to produce ions and exposing sample 40 to the ions to form analytes.

After performing mass analysis, lid 14 can be moved to second operable position 23. In an exemplary aspect lid 14 can be at least partially removed from base 12 and internal component 20 can be at least partially removed from volume 16. During mass analysis, components 30 (FIG. 2) may require inspection between analysis for example for maintenance and trouble shooting requirements.

Internal components 20 such as mass separator components 35 (FIG. 2) can be inspected with lid 14 in second operable position 23. In an exemplary embodiment ion source component 34, such as internal ion source components, including, in exemplary aspects, electron impact filaments, can become fouled during mass analysis and with lid 14 in second operable position 23, ion source components such as the filaments can be replaced with clean filaments or replacement filaments. In an exemplary embodiment mass separator component 35 such as ion trap 52*a-b* (FIGS. 3*a-b*) can become fouled or require replacement during mass analysis and with lid 14 in second operable position 23 mass separator component 35 such as ion trap 52*a-b* can be replaced with a clean or conditioned ion trap. In an exemplary aspect sample inlet component 34, such as a semi-permeable membrane can require cleaning and or replacement during mass analysis and with lid 14 in second operable position 23 sample inlet component 32 can be cleaned or replaced.

In an exemplary embodiment, before moving the lid to operable position 23, ion source component 146 (FIG. 7) can be at least partially or entirely removed from lid 144 and inspected. Upon inspection, ion source component 146 can be cleaned, replaced, or otherwise manipulated.

After inspection, the lid can be returned to first operable position (not shown) and mass analysis can be performed using components 30 (FIG. 2).

At least one arrangement facilitates servicing and reconfiguration of assembly 10. For example, upon removal of the lid assembly or the lid from the base, the internal components, wiring, and tubing, may be removed from the vacuum chamber thereby facilitating servicing, replacement, etc. of such components away from the confines of the vacuum chamber and perhaps reducing the chances of contamination. In one arrangement, the mere removal of the lid also removes at least one or more internal components in the same step. In other arrangements only internal components of interest are removed or perhaps even partially removed to facilitate inspection and/or maintenance while other internal components or portions of components of interest remain within the vacuum chamber. In one arrangement, the lid can be completely removed from the base of assembly 10 that may facilitate the inspection and maintenance of the internal components without the encumbrances of attachments to, or the confines of the base. In another arrangement, the external components can be removed from the lid to perhaps facilitate the inspection of the external component without substantially increasing the pressure within or contaminating the vacuum chamber. It is also contemplated that lid 14 or lid assembly 11 may remain partially coupled to base 12 in the second operable position (e.g. coupled via a hinge).

The following non-limiting examples are provided to further to facilitate aspects of the disclosure with respect to exemplary mass spectrometry operations of assembly 10.

Figure 8:
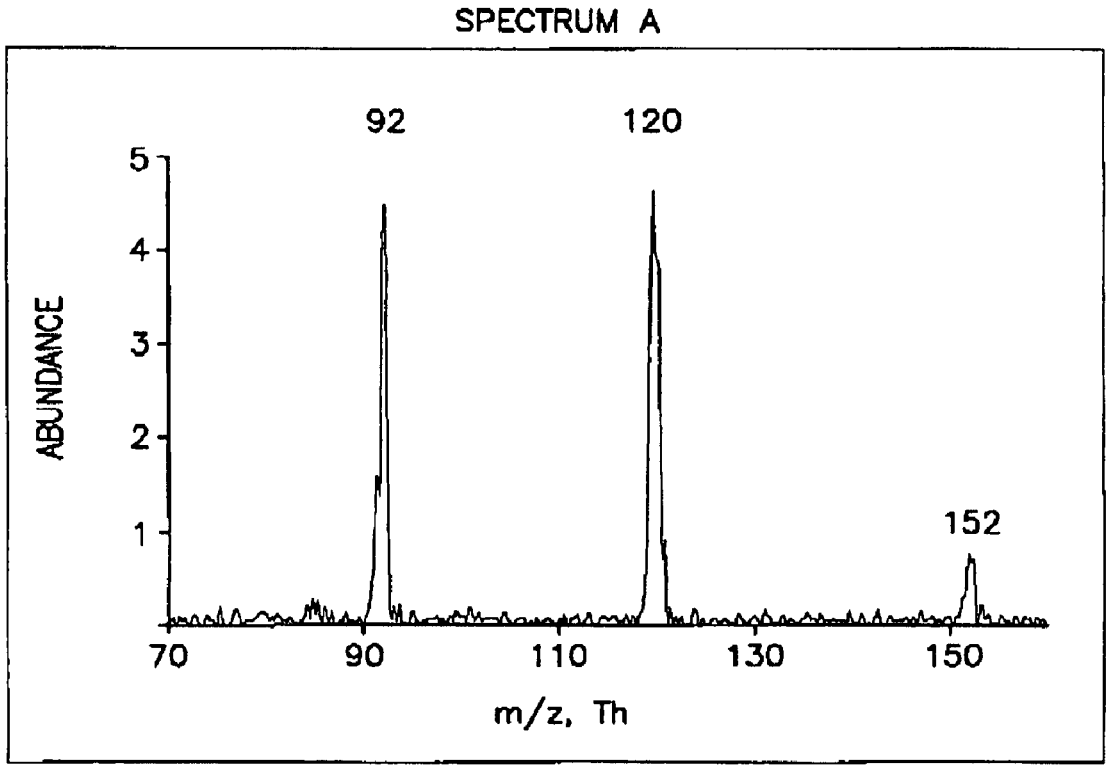
FIG. 8 is example data acquired utilizing assemblies and methods of the disclosure.

Methyl salicylate spectrum in FIG. 8 is obtained with internal Membrane Introduction Mass Spectrometry (MIMS)/internal Electron Ionization (EI) using a Griffin Analytical Technologies (West Lafayette, Ind.) Minotaur Model 2100A CIT Mass Spectrometer.

Figure 9:
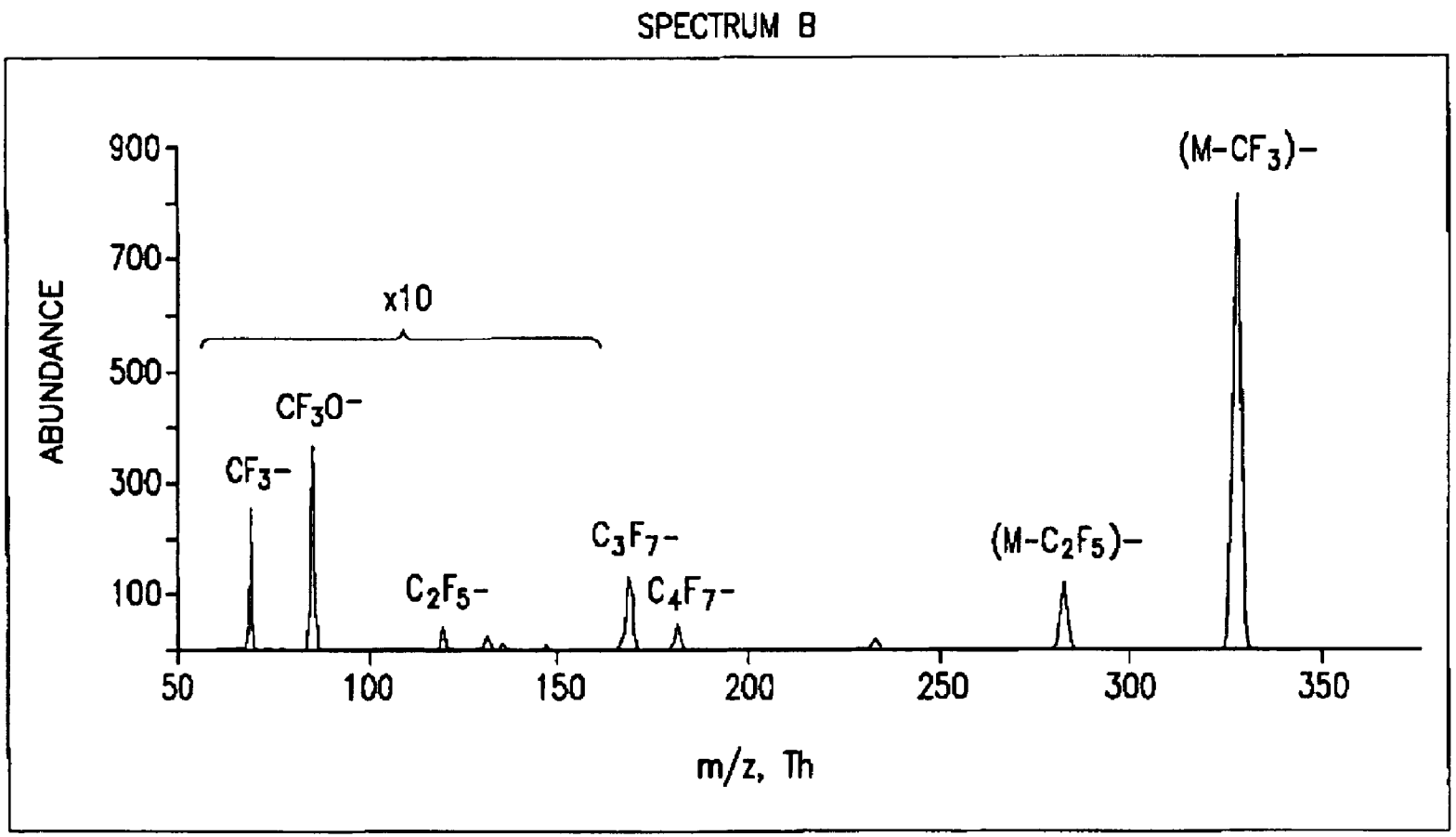
FIG. 9 is example data acquired utilizing assemblies and methods of the disclosure.

Perfluorodimethylcyclohexane (PDCH) spectrum of FIG. 9 is obtained with direct inlet/external glow discharge ionization using a Griffin Analytical Technologies (West Lafayette, Ind.) Minotaur Model 2100A CIT Mass Spectrometer.

Methyl salicylate spectrum of FIG. 10 is obtained with external Membrane Introduction Mass Spectrometry (MIMS)/internal Electron Ionization (EI) using a Griffin Analytical Technologies (West Lafayette, Ind.) Minotaur Model 2100A CIT Mass Spectrometer.

Figure 11:
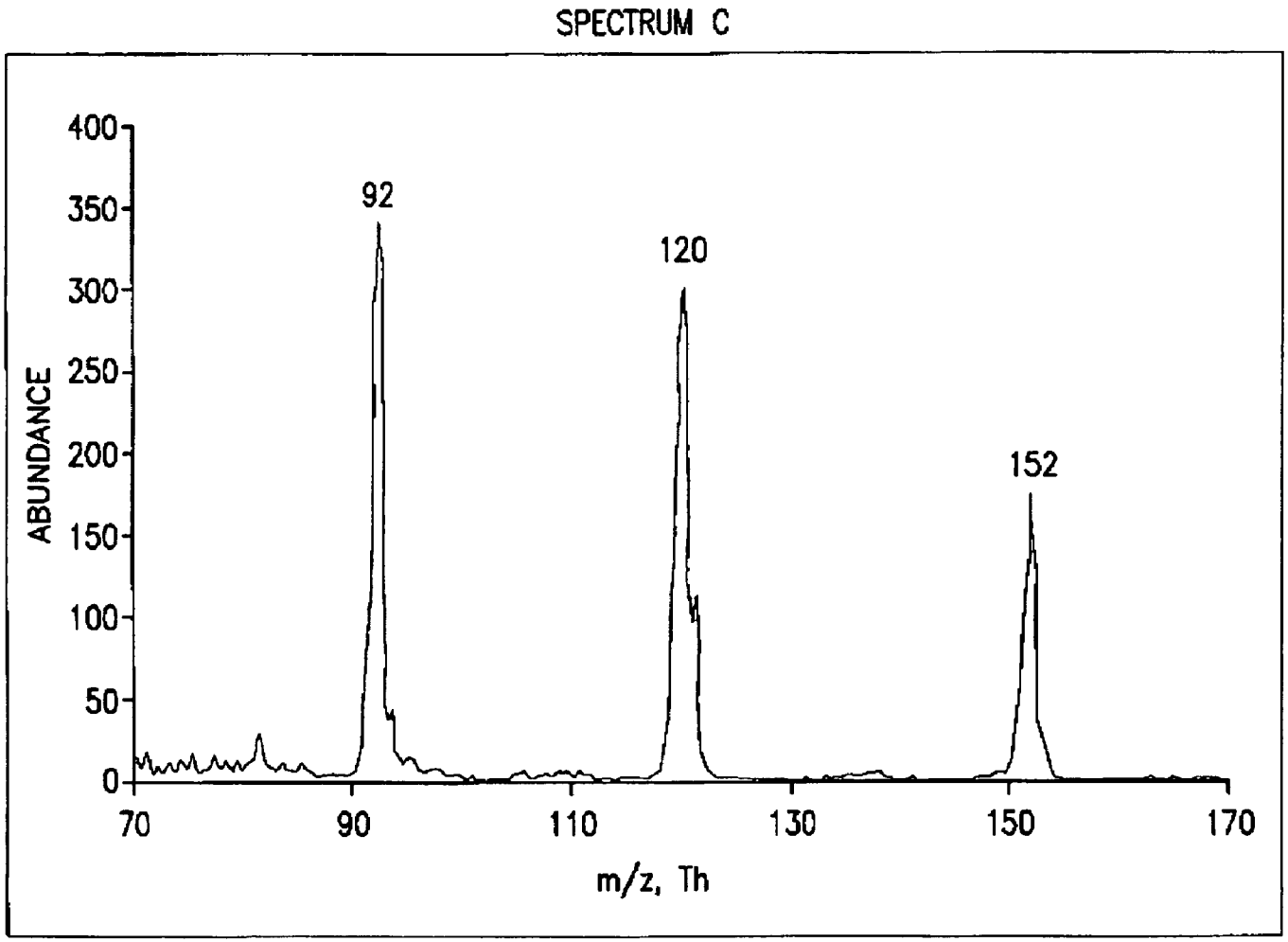
FIG. 11 is example data acquired utilizing assemblies and methods of the disclosure.
Figure 11:
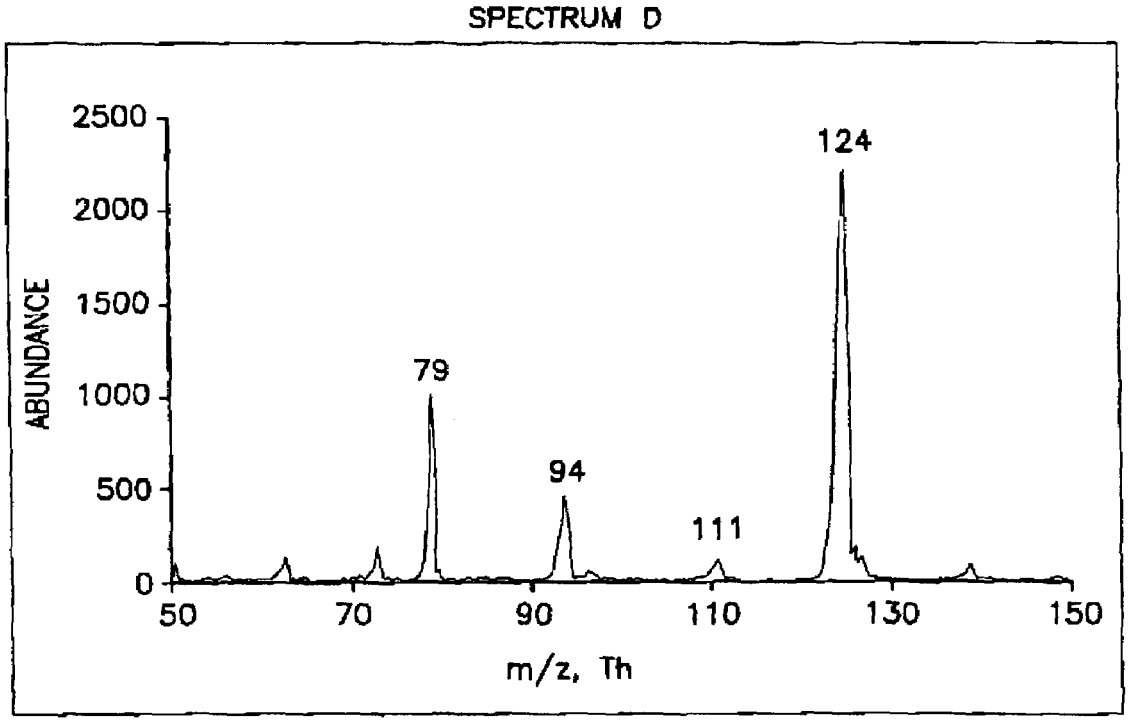

Dimethyl Methylphosphonate (DMMP) of FIG. 11 is obtained with Solid-Phase Microextraction (SPME)/internal Electron Ionization (EI) using a Griffin Analytical Technologies (West Lafayette, Ind.) Minotaur Model 2100A CIT Mass Spectrometer.

What is claimed is:

1. An ion trap mass spectrometer comprising:

a vacuum chamber housing comprising a lid and a base, the lid and the base defining a vacuum chamber volume, and the base comprising at least one wall configured to couple with the lid, wherein the lid comprises:

an interior surface configured to define an interior wall of the vacuum chamber and an exterior surface configured to couple with an analysis component; and a first opening extending through the lid from the analysis component to the interior surface;

an ion trap mass separation component coupled to the interior surface of the lid without being coupled to the base and configured to perform at least some operations with respect to mass separation for use in mass spectrometry, wherein the first opening provides fluid communication between the ion trap and the analysis component;

wherein the lid is configured to be removably operably coupled with respect to the base and positioned in a first operable position to seal with the base and provide the ion trap component wholly within the vacuum chamber volume, and a second position to decouple the lid and all analysis components coupled to the lid from the base and provide the ion trap component wholly outside the vacuum chamber volume.

2. The spectrometer of claim 1 further comprising:

at least one edge of the lid extending between the interior and exterior surfaces and defining a perimeter of the lid; and a second opening extending from the edge through the lid to the first opening.

3. The spectrometer of claim 2 wherein the second opening is configured to receive sample for analysis.

4. The spectrometer of claim 1 wherein the analysis component comprises an ion source component configured to perform at least some operations with respect to providing ions for use in mass spectrometry.

5. The spectrometer of claim 4 further comprising a sample inlet component coupled to the interior wall of the lid and the ion trap component, the sample inlet component being operably configured to expose sample to ions received from the ion source component coupled to the exterior surface of the lid.

6. The spectrometer of claim 5 wherein the sample inlet component comprises a semi-permeable membrane.

* * * * *

UNITED STATES PATENT AND TRADEMARK OFFICE

CERTIFICATE OF CORRECTION

PATENT NO. : 7,427,750 B2
APPLICATION NO. : 10/542187
DATED : September 23, 2008
INVENTOR(S) : Grossenbacher et al.

It is certified that error appears in the above-identified patent and that said Letters Patent is hereby corrected as shown below:

Col. 5, line 41, please delete "32-26" after "components" and insert --32-36--.

Col. 7, line 30, please delete "88" after "surface" and insert --86--.

Col. 8, line 17, please delete "canter" after "the" and insert --center--.

Col. 9, line 65, please delete "to" after "ther".

Signed and Sealed this

Twenty-fourth Day of February, 2009

JOHN DOLL
*Acting Director of the United States Patent and Trademark Office*